US009548062B2

(12) United States Patent
Sugiyama

(10) Patent No.: US 9,548,062 B2
(45) Date of Patent: Jan. 17, 2017

(54) INFORMATION PROCESSING APPARATUS, AUXILIARY DEVICE THEREFOR, INFORMATION PROCESSING SYSTEM, CONTROL METHOD THEREFOR, AND CONTROL PROGRAM

(75) Inventor: Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 545 days.

(21) Appl. No.: 13/505,933

(22) PCT Filed: Nov. 2, 2010

(86) PCT No.: PCT/JP2010/069873

§ 371 (c)(1),
(2), (4) Date: May 3, 2012

(87) PCT Pub. No.: WO2011/055832

PCT Pub. Date: May 12, 2011

(65) Prior Publication Data

US 2012/0224708 A1 Sep. 6, 2012

(30) Foreign Application Priority Data

Nov. 6, 2009 (JP) ..... 2009-255421

(51) Int. Cl.
*G10L 21/0208* (2013.01)

(52) U.S. Cl.
CPC ..... *G10L 21/0208* (2013.01)

(58) Field of Classification Search
CPC ..... G10L 21/0208
(Continued)

(56) References Cited

U.S. PATENT DOCUMENTS 5,245,552 A 9/1993 Andersson et al.
5,701,349 A 12/1997 Sano et al.
(Continued)

FOREIGN PATENT DOCUMENTS

JP 830278 A 2/1996
JP 8-221092 A 8/1996
(Continued)

OTHER PUBLICATIONS

Office Action, dated Dec. 11, 2013, issued by the State Intellectual Property Office of the People's Republic of China, in counterpart Application No. 201080050448.4.
Search Report, dated Sep. 13, 2013, issued by the European Patent Office, in counterpart Application No. 10828390.4.

*Primary Examiner* — Sonia Gay
(74) *Attorney, Agent, or Firm* — Sughrue Mion, PLLC

(57) ABSTRACT

Disclosed is a noise suppression technology for suppressing various types of noise including unknown noise without storing a large number of noise information in advance. Specifically disclosed is an auxiliary device connectable to an information processing apparatus. The information processing apparatus is provided with: means for suppressing noise in a noisy signal, generating the noise information, and suppressing the noise in the noisy signal by using the generated noise information; and noise information generation means for updating the noise information on the basis of the result of suppression of the noise in the noisy signal. The auxiliary device is provided with a mechanism unit for generating noise to be suppressed by the noise suppression means and a mechanism control unit for controlling the mechanism unit so that the noise occurs at a timing at which the noise suppression means performs a noise suppression process.

18 Claims, 12 Drawing Sheets

(58) Field of Classification Search
USPC ..... 381/94.1, 66, 71.1, 94.7
See application file for complete search history.

(56) References Cited

U.S. PATENT DOCUMENTS

| | | | | |
|---|---|---|---|---|
| 2004/0049383 | A1 | 3/2004 | Kato et al. | |
| 2004/0243405 | A1* | 12/2004 | Casparian | G10L 21/0208 704/226 |
| 2005/0102048 | A1* | 5/2005 | Anderson | G06F 3/16 700/94 |
| 2005/0216679 | A1* | 9/2005 | Levy | G06F 11/1461 711/162 |
| 2006/0020451 | A1* | 1/2006 | Kushner et al. | 704/226 |
| 2006/0050895 | A1 | 3/2006 | Nemoto et al. | |
| 2008/0077403 | A1 | 3/2008 | Hayakawa | |
| 2008/0181422 | A1* | 7/2008 | Christoph | G10K 11/1784 381/73.1 |

FOREIGN PATENT DOCUMENTS

| | | | |
|---|---|---|---|
| JP | 2003-216180 | A | 7/2003 |
| JP | 2006-065067 | A | 3/2006 |
| JP | 2006-279185 | A | 10/2006 |
| JP | 2006-287387 | A | 10/2006 |
| JP | 2008-076881 | A | 4/2008 |
| JP | 4282227 | B2 | 6/2009 |
| JP | 4868999 | B2 | 2/2012 |

* cited by examiner

INFORMATION PROCESSING APPARATUS, AUXILIARY DEVICE THEREFOR, INFORMATION PROCESSING SYSTEM, CONTROL METHOD THEREFOR, AND CONTROL PROGRAM

This application is based upon and claims the benefit of priority from Japanese patent application No. 2009-255421, filed on Nov. 6, 2009, the disclosure of which is incorporated herein in its entirety by reference.

TECHNICAL FIELD

The present invention relates to a signal processing technique of suppressing noise in a noisy signal to enhance a target signal.

BACKGROUND ART

A noise suppressing technology is known as a signal processing technology of partially or completely suppressing noise in a noisy signal (a signal containing a mixture of noise and a target signal) and outputting an enhanced signal (a signal obtained by enhancing the target signal). For example, a noise suppressor is a system that suppresses noise mixed in a target audio signal. The noise suppressor is used in various audio terminals such as mobile phones.

Concerning technologies of this type, patent literature 1 discloses a method of suppressing noise by multiplying an input signal by a spectral gain smaller than 1. Patent literature 2 discloses a method of suppressing noise by directly subtracting estimated noise from a noisy signal.

The techniques described in patent literatures 1 and 2 need to estimate noise from the target signal that has already become noisy due to the mixed noise. However, there are limitations on accurately estimating noise only from the noisy signal. Hence, the methods described in patent literatures 1 and 2 are effective only when the noise is much smaller than the target signal. If the condition that the noise is much smaller than the target signal is not satisfied, the noise estimate accuracy is poor. For this reason, the methods described in patent literatures 1 and 2 can achieve no sufficient noise suppression effect, and the enhanced signal includes a larger distortion.

On the other hand, patent literature 3 discloses a noise suppressing system capable of implementing a sufficient noise suppression effect and a smaller distortion in the enhanced signal even if the condition that the noise is much smaller than the target signal is not satisfied. Assuming that the characteristics of noise to be mixed into the target signal are known in advance to a certain extent, the method described in patent literature 3 subtracts previously recorded noise information (information about the noise characteristics) from the noisy signal, thereby suppressing the noise. Patent literature 3 also discloses a method of, if an input signal power obtained by analyzing an input signal is large, integrating a large coefficient into noise information, or if the input signal power is small, integrating a small coefficient, and subtracting the integration result from the noisy signal.

CITATION LIST

Patent Literature

[PTL 1] Japanese Patent No. 4282227
[PTL 2] Japanese Patent Laid-Open No. 8-221092
[PTL 3] Japanese Patent Laid-Open No. 2006-279185

SUMMARY OF INVENTION

However, in the arrangement disclosed in the above-mentioned patent literature 3, it is necessary to store noise characteristic information in advance and therefore, a kind of noise that can be eliminated is very limited. When the kind of noise that can be eliminated is increased, a lot of noise information has to be stored. Accordingly, the required storage capacity increases and a production cost of an apparatus increases. Further, there is a possibility that the noise information stored in advance differs from information on noise to be actually suppressed when an environment changes.

By considering the above-mentioned situation, an object of the present invention is to provide signal processing technology which can solve the above-mentioned problem.

In order to achieve the above-mentioned object, a device according to the present invention is an auxiliary device which can be connected to an information processing apparatus, wherein the information processing apparatus comprises noise suppression means for suppressing noise in a noisy signal by using noise information and noise information generation means for updating the noise information based on a result in which the noise in the noisy signal is suppressed and the auxiliary device comprises a mechanism unit for generating noise to be suppressed by the noise suppression means and a mechanism control unit for controlling the mechanism unit so as to generate the noise at a timing at which the noise suppression means performs a noise suppression process.

In order to achieve the above-mentioned object, an apparatus according to the present invention is an information processing apparatus to which an auxiliary device can be connected, wherein the auxiliary device comprises a mechanism unit for generating noise, the information processing apparatus comprises noise suppression means for suppressing noise in a noisy signal by using noise information and noise information generation means for updating the noise information based on a result in which the noise in the noisy signal is suppressed, the noise suppression means suppresses the noise generated by the mechanism unit, and the noise information generation means updates the noise information based on a result in which the noise generated by the mechanism unit is suppressed.

In order to achieve the above-mentioned object, a system according to the present invention is an information processing system including an information processing apparatus and an auxiliary device connected to the information processing apparatus, wherein the information processing apparatus comprises noise suppression means for suppressing noise in a noisy signal by using noise information and noise information generation means for updating the noise information based on a result in which the noise in the noisy signal is suppressed and the auxiliary device comprises a mechanism unit for generating noise to be suppressed by the noise suppression means and a mechanism control unit for controlling the mechanism unit so as to generate the noise at a timing at which the noise suppression means performs a noise suppression process.

In order to achieve the above-mentioned object, a method according to the present invention is a control method for an auxiliary device which can be connected to an information processing apparatus, wherein the information processing apparatus comprises noise suppression means for suppressing noise in a noisy signal by using noise information and noise information generation means for updating the noise information based on a result in which the noise in the noisy signal is suppressed, the auxiliary device comprises a mechanism unit for generating the noise to be suppressed by the noise suppression means, and the mechanism unit is controlled so as to generate the noise at a timing at which the noise suppression means performs a noise suppression process.

In order to achieve the above-mentioned object, another method according to the present invention is a control method for an information processing apparatus to which an auxiliary device including a mechanism unit for generating noise can be connected, wherein the control method comprises the steps of: suppressing the noise generated by the mechanism unit and updating the noise information based on a result in which the noise in the noisy signal is suppressed.

In order to achieve the above-mentioned object, further another method according to the present invention is a control method for an information processing system including an information processing apparatus and an auxiliary device connected to the information processing apparatus, wherein the control method comprises the steps of: generating noise to be suppressed in the auxiliary device, inputting a noisy signal including the noise generated in the auxiliary device, suppressing the noise in the noisy signal by using noise information, and updating the noise information based on a result in which the noise in the noisy signal is suppressed.

In order to achieve the above-mentioned object, a program stored in a program recording medium according to the present invention is a control program for an auxiliary device which can be connected to an information processing apparatus, wherein the information processing apparatus comprises noise suppression means for suppressing noise in a noisy signal by using noise information and noise information generation means for updating the noise information based on a result in which the noise in the noisy signal is suppressed and the auxiliary device comprises a mechanism unit for generating the noise to be suppressed by the noise suppression means and causes a computer to perform a process for controlling the mechanism unit so as to generate the noise at a timing at which the noise suppression means performs the noise suppression process.

In order to achieve the above-mentioned object, a program stored in another program recording medium according to the present invention is a control program for an information processing apparatus to which an auxiliary device including a mechanism unit for generating noise can be connected, wherein the control program causes a computer to perform a process for suppressing the noise generated by the mechanism unit in a noisy signal by using noise information and a process for updating the noise information based on a result in which the noise in the noisy signal is suppressed.

Advantageous Effect of Invention

According to the present invention, it is possible to provide a signal processing technique of suppressing various kinds of noise including unknown noise without storing a number of pieces of noise information in advance.

EXEMPLARY EMBODIMENTS

Exemplary embodiments will now be described in detail by way of example with reference to the accompanying drawings. Note that the constituent elements described in the exemplary embodiments are merely examples, and the technical scope is not limited by the following exemplary embodiments.

First Exemplary Embodiment

Overall Arrangement

Figure 1:
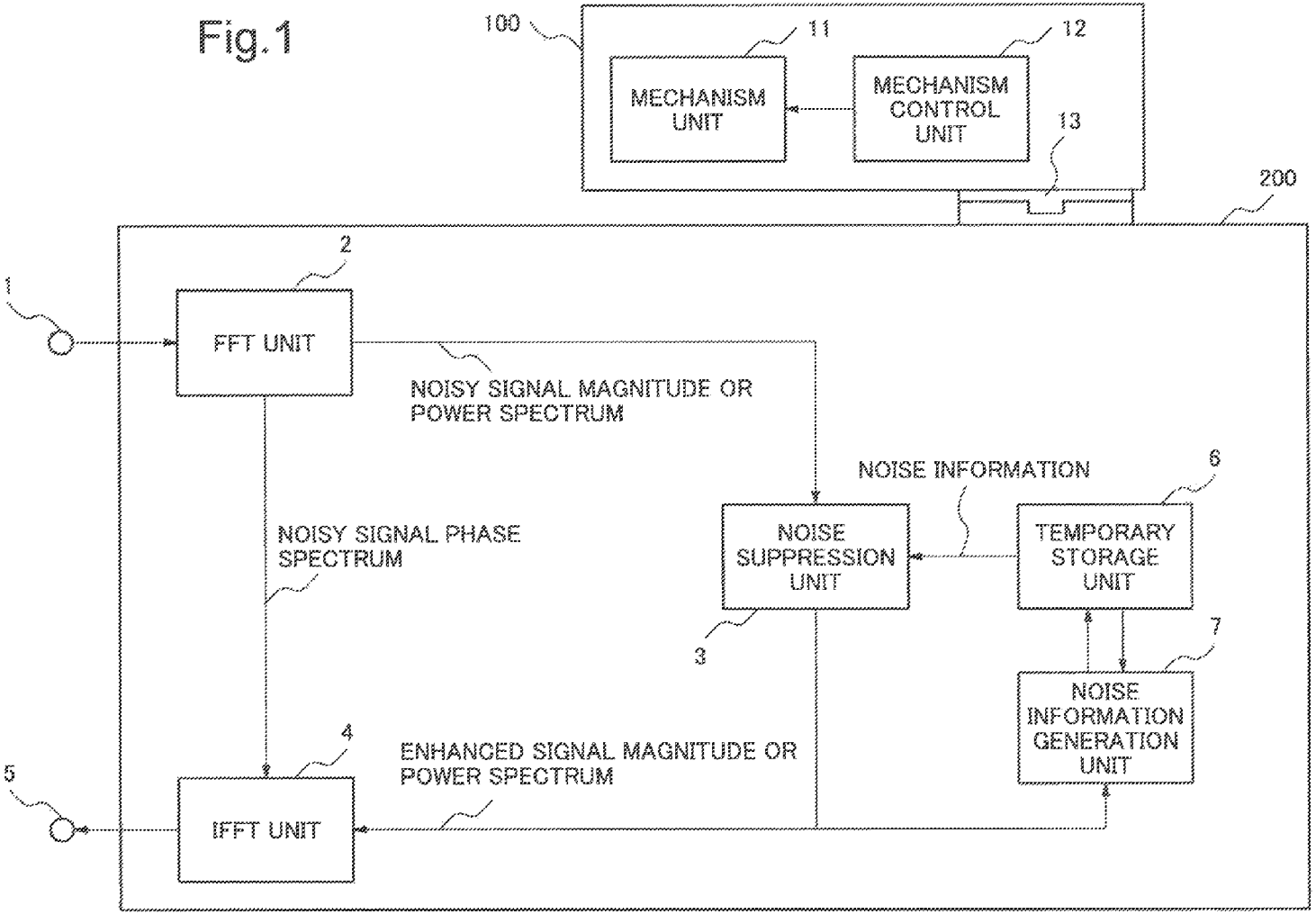
FIG. 1 is a block diagram showing a schematic arrangement of the information processing system according to the first exemplary embodiment of the present invention.
Figure 12:
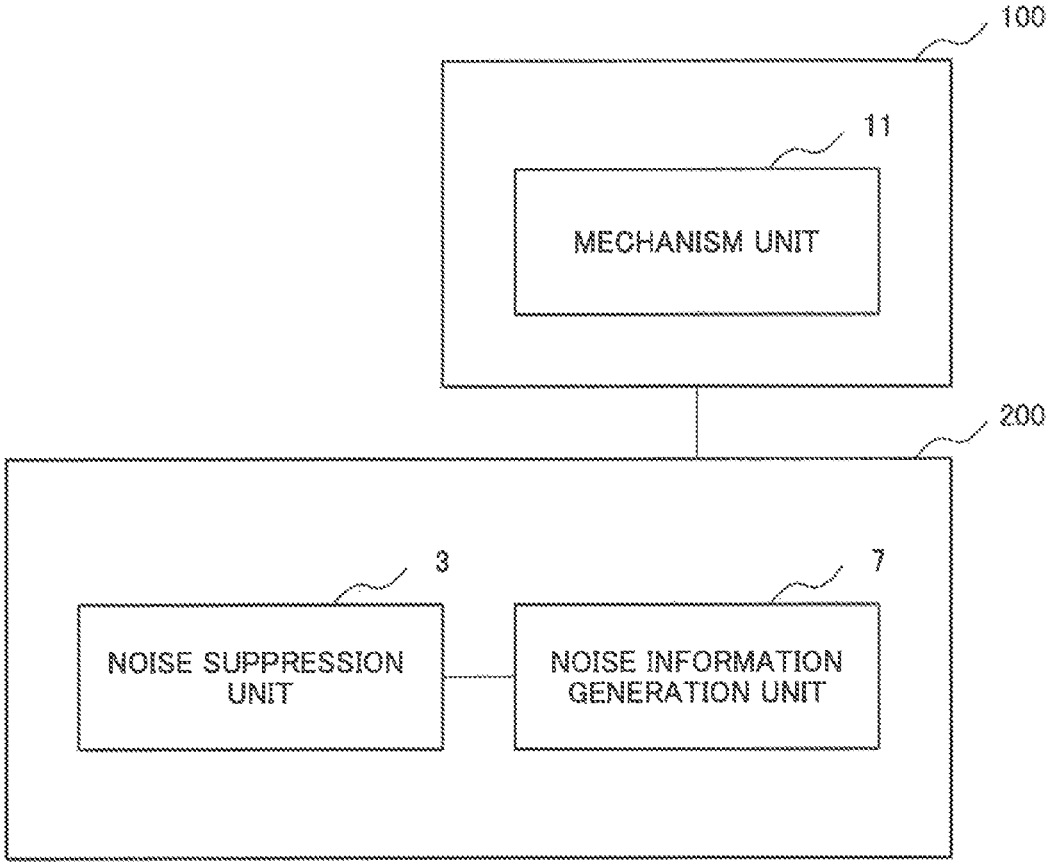
FIG. 12 is a figure showing an example of the arrangement of the information processing system of the present invention.

An information processing apparatus and an auxiliary device therefor according to a first exemplary embodiment of the present invention will be described. FIG. 1 and FIG. 12 are block diagrams showing the information processing system in which an auxiliary device 100 and an information processing apparatus 200 are connected. The information processing apparatus 200 is specifically, an apparatus such as a digital camera, a laptop computer, a PDA, a mobile phone, or the like. On the other hand, the auxiliary device 100 is specifically, a device such as a lens and a flashlight device that are connected to a camera, a media drive and an external keyboard that are connected to a laptop computer, a PDA, or a mobile phone, or the like. Namely, all these products can be included in the category of the present invention. Of course, the present invention is not limited to these devices. The present invention can be applied to all information processing apparatuses and/or all auxiliary devices which generate noise in which it is required to remove noise from an input signal.

<Arrangement of Main Body>

First, the arrangement of the information processing apparatus 200 that is a main body will be described. A noisy signal (a signal containing a mixture of noise and a target signal) is input to an input terminal 1 as a sample value sequence. An FFT unit 2 performs transform such as Fourier transform of the noisy signal supplied to the input terminal 1, thereby dividing the signal into a plurality of frequency components. The noise suppression unit 3 receives the magnitude spectrum out of the plurality of frequency components, whereas an IFFT unit 4 is provided with the phase spectrum. Note that the magnitude spectrum is supplied to the noise suppression unit 3 in this case. However, the exemplary embodiment is not limited to this, and a power spectrum corresponding to the square of the magnitude spectrum may be supplied to the noise suppression unit 3.

A temporary storage unit 6 includes a memory element such as a semiconductor memory and stores noise information (information about noise characteristics). In particular, the temporary storage unit 6 stores noise spectrum forms as the noise information. However, the temporary storage unit 6 can also store, for example, the frequency characteristics of phases and features such as the intensities and time-rate changes for a specific frequency in place of or together with the spectra. The noise information can also include statistics (maxima, minima, variances, and medians) and the like.

The noise suppression unit 3 suppresses noise at each frequency using the noisy signal magnitude spectrum supplied by the FFT unit 2 and the noise information supplied by the temporary storage unit 6, and provides the IFFT unit 4 with an enhanced signal magnitude spectrum as a noise suppression result. The IFFT unit 4 inversely transforms the combination of the enhanced signal magnitude spectrum supplied from the noise suppression unit 3 and the noisy signal phase supplied from the FFT unit 2, and supplies an enhanced signal sample to an output terminal 5.

The enhanced signal magnitude spectrum that is the noise suppression result is simultaneously transmitted to a noise information generation unit 7. The noise information generation unit 7 generates new noise information based on the enhanced signal magnitude spectrum that is the noise suppression result and supplies it to the temporary storage unit 6. The temporary storage unit 6 updates the current noise information by using the new noise information supplied by the noise information generation unit 7.

<Arrangement of FFT Unit 2>

Figure 2:
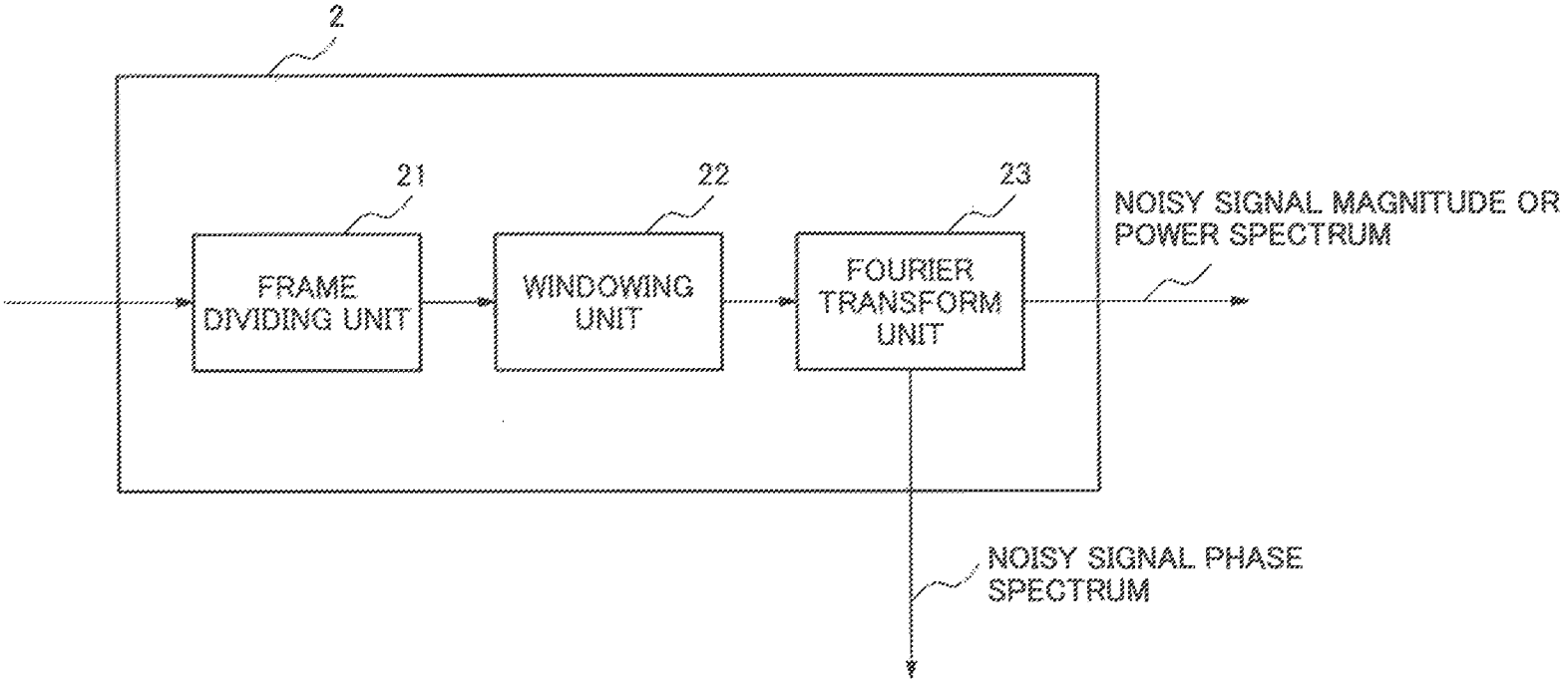
FIG. 2 is a block diagram showing the arrangement of the FFT unit 2 included in the information processing apparatus according to the first exemplary embodiment of the present invention.

FIG. 2 is a block diagram showing the arrangement of the FFT unit 2. As shown in FIG. 2, the FFT unit 2 includes a frame dividing unit 21, a windowing unit 22, and a Fourier transform unit 23. The frame dividing unit 21 receives the noisy signal sample and divides it into frames corresponding to K/2 samples, where K is an even number. The noisy signal sample divided into frames is supplied to the windowing unit 22 and multiplied by a window function w(t). The signal obtained by windowing an nth frame input signal yn(t) (t=0, 1, . . . , K/2−1) by w(t) is given by $$\bar{y}_n(t)=w(t)y_n(t) \tag{1}$$

Also widely conducted is windowing two successive frames partially overlaid (overlapping) each other. Assume that the overlap length is 50% the frame length. For t=0, 1, . . . , K/2−1, the windowing unit 22 outputs $\bar{y}_n(t)$ and $\bar{y}_n(t+K/2)$ given by $$\left.\begin{aligned}\bar{y}_n(t) &= w(t)y_{n-1}(t+K/2)\\ \bar{y}_n(t+K/2) &= w(t+K/2)y_n(t)\end{aligned}\right\} \tag{2}$$

A symmetric window function is used for a real signal. The window function makes the input signal match the output signal except an error when the spectral gain is set to 1 in the MMSE STSA method or zero is subtracted in the SS method. This means w(t)=w(t+K/2)=1.

The example of windowing two successive frames that overlap 50% will continuously be described below. The windowing unit 22 can use, for example, a hanning window w(t) given by $$w(t)=\begin{cases}0.5+0.5\cos\left(\dfrac{\pi(t-K/2)}{K/2}\right), & 0\le t<K\\ 0, & \text{otherwise}\end{cases} \tag{3}$$

Alternatively, the windowing unit 22 may use various window functions such as a hamming window, a Kaiser window, and a Blackman window. The windowed output is supplied to the Fourier transform unit 23 and transformed into a noisy signal spectrum Yn(k). The noisy signal spectrum Yn(k) is separated into the phase and the magnitude. A noisy signal phase spectrum argYn(k) is supplied to the IFFT unit 4, whereas a noisy signal magnitude spectrum |Yn(k)| is supplied to the noise suppression unit 3. As already described, the FFT unit 2 can use the power spectrum instead of the magnitude spectrum.

<Arrangement of IFFT Unit 4>

Figure 3:
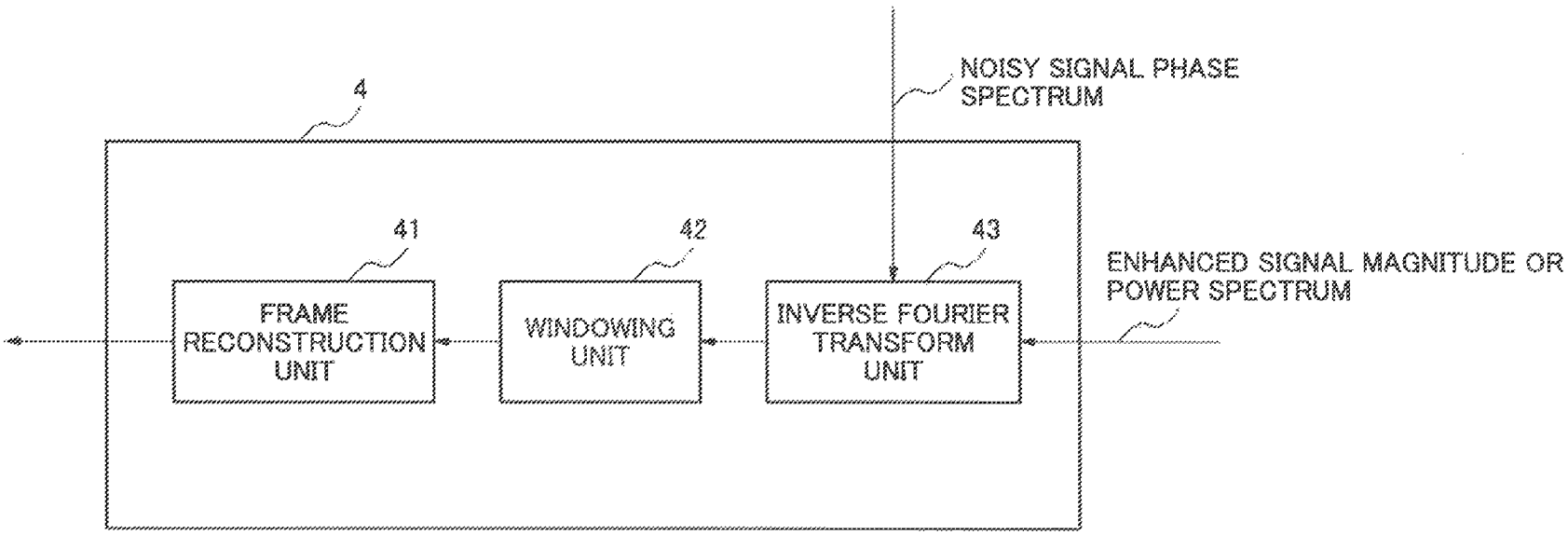
FIG. 3 is a block diagram showing the arrangement of the IFFT unit 4 included in the information processing apparatus according to the first exemplary embodiment of the present invention.

FIG. 3 is a block diagram showing the arrangement of the IFFT unit 4. As shown in FIG. 3, the IFFT unit 4 includes an inverse Fourier transform unit 43, a windowing unit 42, and a frame reconstruction unit 41. The inverse Fourier transform unit 43 combines the enhanced signal magnitude spectrum supplied from the noise suppression unit 3 with the noisy signal phase spectrum arg Yn(k) supplied from the FFT unit 2 to obtain an enhanced signal given by $$\bar{X}_n(k)=|\bar{X}_n(k)|\cdot arg\ Y_n(k) \tag{4}$$

The inverse Fourier transform unit 43 inversely Fourier-transforms the resultant enhanced signal. The inversely Fourier-transformed enhanced signal is supplied to the windowing unit 42 as a series of time domain samples xn(t) (t=0, 1, . . . , K−1) in which one frame includes K samples and multiplied by the window function w(t). The signal obtained by windowing an nth frame input signal xn(t) (t=0, 1, . . . , K/2−1) by w(t) is given by $$\hat{x}_n(t)=w(t)x_n(t) \tag{5}$$

Also widely conducted is windowing two successive frames partially overlaid (overlapping) each other. Assume that the overlap length is 50% the frame length. For t=0, 1, . . . , K/2−1, the windowing unit 42 outputs $\bar{x}_n(t)$ and $\bar{x}_n(t+K/2)$ given by $$\left.\begin{aligned}\bar{x}_n(t) &= w(t)x_{n-1}(t+K/2)\\ \bar{x}_n(t+K/2) &= w(t+K/2)x_n(t)\end{aligned}\right\} \tag{6}$$

and provides the frame reconstruction unit 41 with them.

The frame reconstruction unit 41 extracts the output of two adjacent frames from the windowing unit 42 for every K/2 samples, overlays them, and obtains an output signal $\hat{X}_n(t)$ given by $$\hat{x}_n(t)=\bar{x}_{n-1}(t+K/2)+\hat{x}_n(t) \quad (7)$$

for t=0, 1, . . . , K−1. The frame reconstruction unit 41 provides the output terminal 5 with the resultant output signal.

Note that the transform in the FFT unit 2 and the IFFT unit 4 in FIGS. 2 and 3 has been described above as Fourier transform. However, the FFT unit 2 and the IFFT unit 4 can use any other transform such as cosine transform, modified discrete cosine transform (MDCT), Hadamard transform, Haar transform, or Wavelet transform in place of the Fourier transform. For example, cosine transform or modified cosine transform obtains only a magnitude as a transform result. This obviates the necessity for the path from the FFT unit 2 to the IFFT unit 4 in FIG. 1. In addition, the noise information recorded in the temporary storage unit 6 needs to include only magnitudes (or powers), contributing to reduction of the memory size and the number of computations of a noise suppressing process. Haar transform allows to omit multiplication and reduce the area of an LSI chip. Since Wavelet transform can change the time resolution depending on the frequency, better noise suppression is expected.

Alternatively, after the FFT unit 2 has integrated a plurality of frequency components, the noise suppression unit 3 may perform actual suppression. In this case, the FFT unit 2 can achieve high sound quality by integrating more frequency components from the low frequency range where the discrimination capability of hearing characteristics is high to the high frequency range with a poorer capability. When noise suppression is executed after integrating a plurality of frequency components, the number of frequency components to which noise suppression is applied decreases. The noise suppressing apparatus 200 can thus decrease the whole number of computations.

<Processing of Noise Suppression Unit 3>

The noise suppression unit 3 can perform various kinds of suppression. Typical suppressing methods are the SS (Spectrum Subtraction) method and the MMSE STSA (Minimum Mean-Square Error Short-Time Spectral Amplitude Estimator) method. When using the SS method, the noise suppression unit 3 subtracts the noise information supplied by the temporary storage unit 6 from the noisy signal magnitude spectrum supplied by the FFT unit 2. When using the MMSE STSA method, the noise suppression unit 3 calculates a spectral gain for each of the plurality of frequency components using the noise information supplied by the temporary storage unit 6 and the noisy signal magnitude spectrum supplied by the FFT unit 2. The noise suppression unit 3 then multiplies the noisy signal magnitude spectrum by the spectral gain. The spectral gain is determined so as to minimize the mean square power of the enhanced signal.

The noise suppression unit 3 can apply flooring to avoid excessive noise suppression. Flooring is a method of avoiding suppression beyond the maximum suppression amount. A flooring parameter determines the maximum suppression amount. When using the SS method, the noise suppression unit 3 imposes restrictions so the result obtained by subtracting the noise information from the noisy signal magnitude spectrum is not smaller than the flooring parameter. More specifically, if the subtraction result is smaller than the flooring parameter, the noise suppression unit 3 replaces the subtraction result with the flooring parameter. In case of using the MMSE STSA method, if the spectral gain obtained from the noise information and the noisy signal magnitude spectrum is smaller than the flooring parameter, the noise suppression unit 3 replaces the spectral gain with the flooring parameter. Details of the flooring are disclosed in literature "M. Berouti, R. Schwartz, and J. Makhoul, "Enhancement of speech corrupted by acoustic noise", Proceedings of ICASSP'79, pp. 208-211, April 1979". When the flooring is introduced, the noise suppression unit 3 does not perform excessive suppression. The flooring can prevent the enhanced signal from having a larger distortion.

The noise suppression unit 3 can also set the number of frequency components of the noise information to be smaller than the number of frequency components of the noisy signal spectrum. At this time, a plurality of frequency components share a plurality of pieces of noise information. The frequency resolution of the noisy signal spectrum is higher than in a case in which the plurality of frequency components are integrated for both the noisy signal spectrum and the noise information. For this reason, the noise suppression unit 3 can achieve high sound quality by calculation in an amount smaller than in case of the absence of frequency component integration. Japanese Patent Laid-Open No. 2008-203879 discloses details of suppression using noise information whose number of frequency components is smaller than the number of frequency components of the noisy signal spectrum.

<Arrangement of Noise Information Generation Unit 7>

The enhanced signal magnitude spectrum that is the noise suppression result is supplied to the noise information generation unit 7. The noise information generation unit 7 generates the new noise information by using this noise suppression result and updates the noise information stored in the temporary storage unit 6 by using this. As an initial value of the noise information stored in the temporary storage unit 6, for example, a signal spectrum with a flat shape is set in advance. The noise information generation unit 7 generates the new noise information according to the noise suppression result in which the signal spectrum is used as the noise information. The noise information generation unit 7 updates the noise information that is stored in the temporary storage unit 6 and has already been used for the suppression by using this new noise information.

When adapting the new noise information using the noise suppression result fed back to The noise information generation unit 7, The noise information generation unit 7 generates the noise information such that the larger the noise suppression result at a timing without target signal input is (the larger the noise remaining without being suppressed is), the larger the noise information is. The large noise suppression result at the timing without target signal input indicates insufficient suppression. For this reason, the noise information is preferably made larger by changing the scaling factor. When the noise information is large, the subtraction value of the SS method is large, and the noise suppression result thus becomes small. In multiplication-based suppression such as the MMSE STSA method, the signal-to-noise ratio (SNR) estimate to be used to calculate the spectral gain is small, and therefore, a small spectral gain can be obtained. This leads to more intensive suppression. A plurality of methods are available to generate the noise information. A re-calculation algorithm and a recursive adaptation algorithm will be described as examples.

In an ideal noise suppression result, noise is completely suppressed. The noise information generation unit 7 can recalculate or recursively adapt the noise information, for example, when the magnitude or power of the noisy signal is small so as to completely suppress noise. This is because the power of the signal other than the noise to be suppressed is small at high probability when the magnitude or power of the noisy signal is small. The noise information generation unit 7 can detect the small magnitude or power of the noisy signal using the fact that an absolute value of the magnitude or power of the noisy signal is smaller than a threshold.

The noise information generation unit 7 can also detect the small magnitude or power of the noisy signal using the fact that the difference between the magnitude or power of the noisy signal and the noise information recorded in the temporary storage unit 6 is smaller than a threshold. That is, the noise information generation unit 7 uses the fact that when the magnitude or power of the noisy signal is similar to the noise information, the noise information makes up a large part of the noisy signal (the SNR is low). Especially, the noise information generation unit 7 can compare the spectral envelopes using a combination of information at a plurality of frequency points, thereby raising the detection accuracy.

The noise information in the SS method is recalculated such that the modified noise information equals the noisy signal spectrum for each frequency at the timing without target signal input. In other words, the noise information generation unit 7 calculates so as to make the noisy signal magnitude spectrum |Yn(k)| supplied from the FFT unit 2 when only noise has been input match the noise information νn(k). That is, the noise information $\nu_n(k)$ is calculated by $$\nu n(k)=|Yn(k)| \tag{8}$$

where n is the frame number, and k is the frequency number.

The noise information generation unit 7 may use an average of the noise information νn(k) instead of using it directly. An average (a moving average using a slide window) based on an FIR filter or an average (leaky integration) based on an IIR filter may be used for the average.

On the other hand, recursive adaptation of the noise information in the SS method is done by gradually adapting the scaling factor such that the enhanced signal magnitude spectrum at the timing without target signal input approaches zero for each frequency. When using the perturbation method for recursive adaptation, the noise information generation unit 7 calculates αn+1(k) using an error en(k) of the nth frame for the frequency number k as $$\nu n+1(k)=\nu n(k)+\mu en(k) \tag{9}$$

where μ is a microconstant called a step size. If the noise information $\nu_n(k)$ obtained by the calculation is to be used immediately, the noise information generation unit 7 uses $$\nu n(k)=\nu n-1(k)+\mu en(k) \tag{10}$$

in place of equation (9).

Namely, the noise information generation unit 7 calculates the current noise information νn(k) by using a current error and immediately applies it. The noise information generation unit 7 can realize the noise suppression with high precision in real-time by immediately updating the noise information.

Further, the noise information generation unit 7 may calculate the noise information νn+1(k) by the following equation (11) by using a signum function sgn{en (k)} representing only the sign of the error.

$$\nu n+1(k)=\nu n(k)+\mu^{*}sgn\{en(k)\} \tag{11}$$

Similarly, the noise information generation unit 7 may use another adaptive algorithm (sequential update algorithm).

The MMSE STSA method recursively adapts the noise information. The noise information generation unit 7 adapts the noise information $\nu_n(k)$ for each frequency by the same methods as those described using equations (9) to (11).

As the characteristic features of the above-described re-calculation and recursive adaptation algorithms serving as the noise information adaptation method, the re-calculation algorithm has a high follow-up speed, and the recursive adaptation algorithm has a high accuracy. To make use these characteristic features, the noise information generation unit 7 may change the adaptation method so as to, for example, first use the re-calculation algorithm and then use the recursive adaptation algorithm. When determining the timing to change the adaptation method, the noise information generation unit 7 may change the adaptation method on condition that the noise information has sufficiently approached the optimum value. Alternatively, the noise information generation unit 7 may change the adaptation method when, for example, a predetermined time has elapsed. Otherwise, the noise information generation unit 7 may change the adaptation method when the modification amount of the noise information has fallen below a predetermined threshold.

<Arrangement of Auxiliary Device>

Next, the arrangement of the auxiliary device 100 will be described. The auxiliary device 100 includes a mechanism unit 11 that is a noise generation source and a mechanism control unit 12 that controls the mechanism unit 11 and is connected to the information processing apparatus 200 via a connection unit 13.

For example, when the auxiliary device 100 is connected to the information processing apparatus 200 and a power is supplied to the auxiliary device 100, the mechanism control unit 12 makes the mechanism unit 11 operates at a predetermined timing. As a result, the noise occurs from the mechanism unit 11 at the predetermined timing. This noise is a noise to be suppressed by the noise suppression unit 3.

On the other hand, on the information processing apparatus 200 side, a state in which a power supply of the auxiliary device 100 is switched on is detected and the noise suppression unit 3 and the noise information generation unit 7 operate at a timing at which the noise occurs in the mechanism unit 11. Specifically, the noise which occurs in the mechanism unit 11 is inputted from an input terminal 1. The noise suppression unit 3 suppresses the inputted noise and provides a noise suppression result to the noise information generation unit 7. The noise information generation unit 7 generates the noise information according to the noise suppression result, and overwrites and stores it in the temporary storage unit 6.

With respect to the predetermined timing, a predetermined condition such as for example, "for 2 seconds after being connected" or the like is stored in each of the auxiliary device 100 and the information processing apparatus 200. The mechanism unit 11 in the auxiliary device 100, and the noise suppression unit 3 and the noise information generation unit 7 in the information processing apparatus 200 are controlled at the approximately-same timing and the noise information is generated from the noise that occurs.

Thus, according to the arrangement of this exemplary embodiment, the mechanism control unit 12 controls the mechanism unit 11 so as to generate the noise at a timing at which the noise suppression unit 3 performs the noise suppression process. The mechanism control unit 12 makes the mechanism unit 11 intentionally generate the noise that is a suppression target and the noise information can be generated by using the generated noise.

Namely, the noise information is generated from the noise with a high possibility of being mixed into the noisy signal actually regardless of a change in environment or the like. Therefore, the information processing apparatus 200 can properly suppress the noise in the noisy signal. The information processing apparatus 200 can suppress the various types of noise including unknown noise without storing a large number of noise information in advance. Further, when the noise signal is generated, the noise information is directly generated by using the noise suppression result. However, the present invention is not limited to this. The information processing apparatus 200 can update a multiplying coefficient in an arrangement in which the noise information is generated by multiplying reference information by the multiplying coefficient or update the multiplying coefficient and an offset in an arrangement in which a value obtained by adding an offset after multiplying reference information by the multiplying coefficient is used as the noise information. Additionally, the information processing apparatus 200 may generate the noise information from the reference information by using a polynomial equation or a non-linear function. Further, the information processing apparatus 200 can use an arrangement in which not only the multiplying coefficient and the offset but also the reference information is simultaneously updated.

Second Exemplary Embodiment

Figure 4:
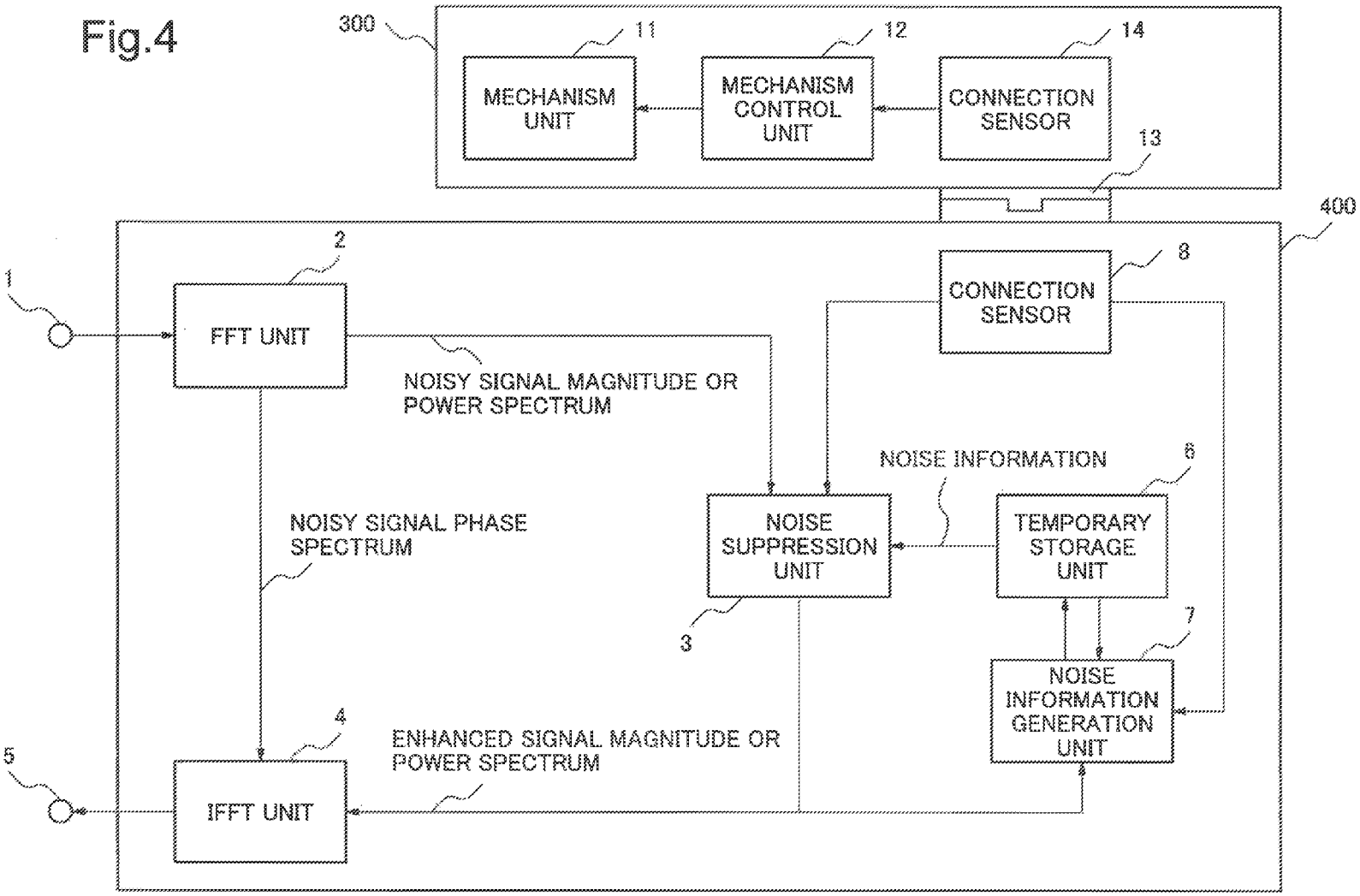
FIG. 4 is a block diagram showing the schematic arrangement of the information processing system according to the second exemplary embodiment of the present invention.

A second exemplary embodiment of the present invention will be described by using FIG. 4. An auxiliary device 300 and an information processing apparatus 400 in this exemplary embodiment have an connection sensor 14 and an connection sensor 8 in addition to the arrangement of the first exemplary embodiment.

When the auxiliary device 300 is connected to the information processing apparatus 400, the connection sensor 14 notifies the mechanism control unit 12 of the information indicating that the auxiliary device 300 is connected to the information processing apparatus 400. In response to this notification, the mechanism control unit 12 makes the mechanism unit 11 operate at the predetermined timing. As a result, the noise to be suppressed by the noise suppression unit 3 noise is generated from the mechanism unit 11 at the predetermined timing.

On the other hand, on the information processing apparatus 400 side, the notification indicating that the auxiliary device 300 is connected to the information processing apparatus 400 is transmitted from the connection sensor 8 to the noise suppression unit 3 and the noise information generation unit 7 and these units are operated at the predetermined timing. Specifically, the noise generated by the mechanism unit 11 is inputted from the input terminal 1 and suppressed by the noise suppression unit 3. The noise suppression unit 3 provides the noise suppression result to the noise information generation unit 7. The noise information generation unit 7 generates the noise information according to the noise suppression result, and overwrites and stores it in the temporary storage unit 6. Namely, the noise information generation unit 7 generates the noise information so that the suppression result of the noise suppression unit 3 is zero under a condition in which only the noise of the mechanism unit 11 is inputted.

With respect to the predetermined timing, a predetermined condition such as for example, "for 2 seconds after connecting the auxiliary device" or the like is stored in each of the auxiliary device 300 and the information processing apparatus 400. In the auxiliary device 300, the mechanism unit 11 is controlled and the information processing apparatus 400 generates the noise information from the noise that is generated.

As a result, the information processing apparatus 400 can certainly suppress the noise at a timing at which the specific noise exists and at the same time, generate the noise information. The arrangement other than the arrangement explained in this exemplary embodiment and the operation are the same as those of the first exemplary embodiment. Therefore, the detailed description will be omitted here.

Third Exemplary Embodiment

Figure 5:
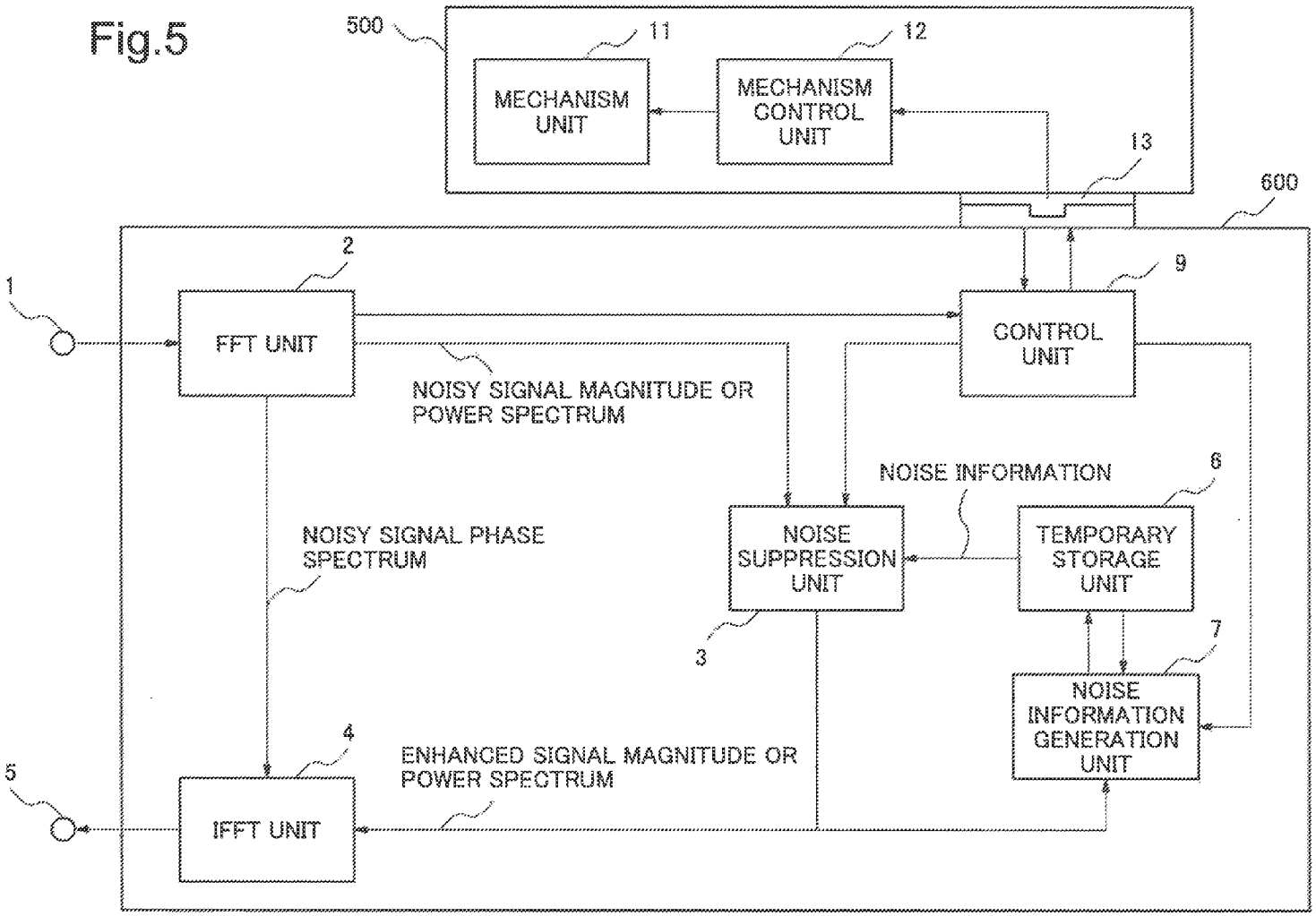
FIG. 5 is a block diagram showing the schematic arrangement of the information processing system according to the third exemplary embodiment of the present invention.

A third exemplary embodiment of the present invention will be described by using FIG. 5. An information processing apparatus 600 according to this exemplary embodiment includes a control unit 9 and the mechanism control unit 12 of an auxiliary device 500 receives a control from the control unit 9. The control unit 9 inputs a spectrum signal outputted by the FFT unit 2, analyzes it, and determines whether or not a mixed level of a signal other than the noise to be suppressed is smaller than the predetermined threshold value. As an example of such analysis, the control unit 9 can evaluate a spectrum signal power. In this case, the control unit 9 determines whether or not the power is smaller than the threshold value.

When the mixed level of noise is small, the control unit 9 instructs the mechanism control unit 12 to make the mechanism unit 11 operate and whereby, the noise is generated. As a result, the noisy signal inputted from the input terminal 1 is composed of the noise almost all generated by the mechanism unit 11. The control unit 9 makes the noise suppression unit 3 and the noise information generation unit 7 operate at that timing. When the noise information is generated or the multiplying coefficient is adjusted by the noise information generation unit 7 so that the suppression result of the noise suppression unit 3 is zero, a very high noise suppression precision can be obtained. The arrangement other than the arrangement explained in this exemplary embodiment and the operation are the same as those of the first exemplary embodiment. Therefore, the detailed description will be omitted here.

Fourth Exemplary Embodiment

Figure 6:
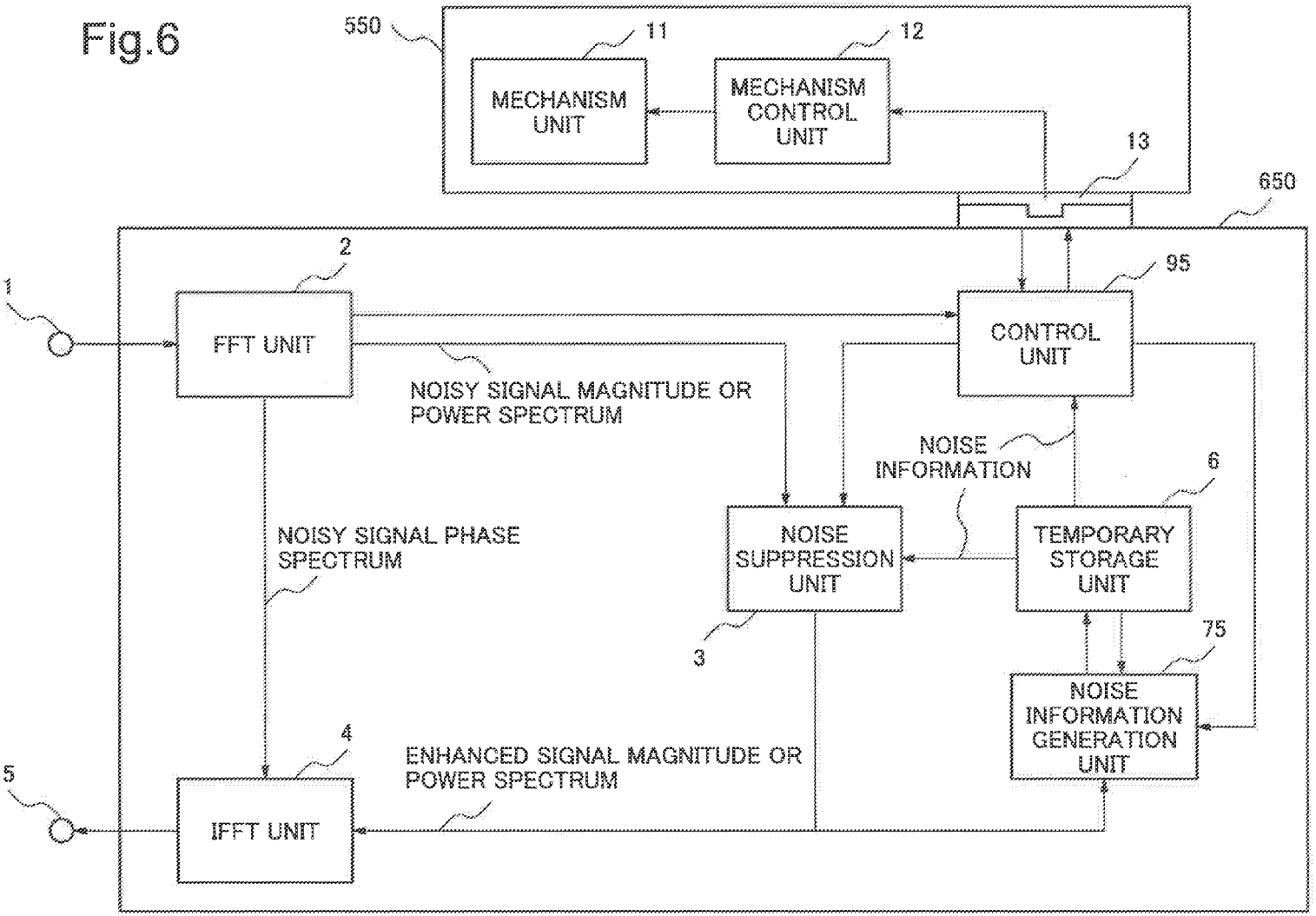
FIG. 6 is a block diagram showing the schematic arrangement of the information processing system according to the fourth exemplary embodiment of the present invention.

A fourth exemplary embodiment of the present invention will be described by using FIG. 6. An information processing apparatus 650 according to this exemplary embodiment includes a control unit 95 and the mechanism control unit 12 of an auxiliary device 550 is controlled from the control unit 95. The control unit 95 makes the mechanism unit 11 operates like the first exemplary embodiment. Further, the control unit 95 inputs the spectrum signal outputted by the FFT unit 2, analyzes it, and determines whether or not the signal is similar to the noise information supplied by the temporary storage unit 6. The information processing apparatus 650 further includes a noise information generation unit 75. The analysis result is supplied to the noise information generation unit 75 from the control unit 95.

When the spectrum signal outputted by the FFT unit 2 is similar to the noise information supplied from the temporary storage unit 6, the control unit 95 makes the noise suppression unit 3 and the noise information generation unit 75 operate. When the noise information is generated or the multiplying coefficient is adjusted by the noise information generation unit 75 so that the suppression result of the noise suppression unit 3 is zero, a very high noise suppression precision can be obtained. The arrangement other than the arrangement explained in this exemplary embodiment and the operation are the same as those of the first exemplary embodiment. Therefore, the detailed description will be omitted here.

Fifth Exemplary Embodiment

Figure 7:
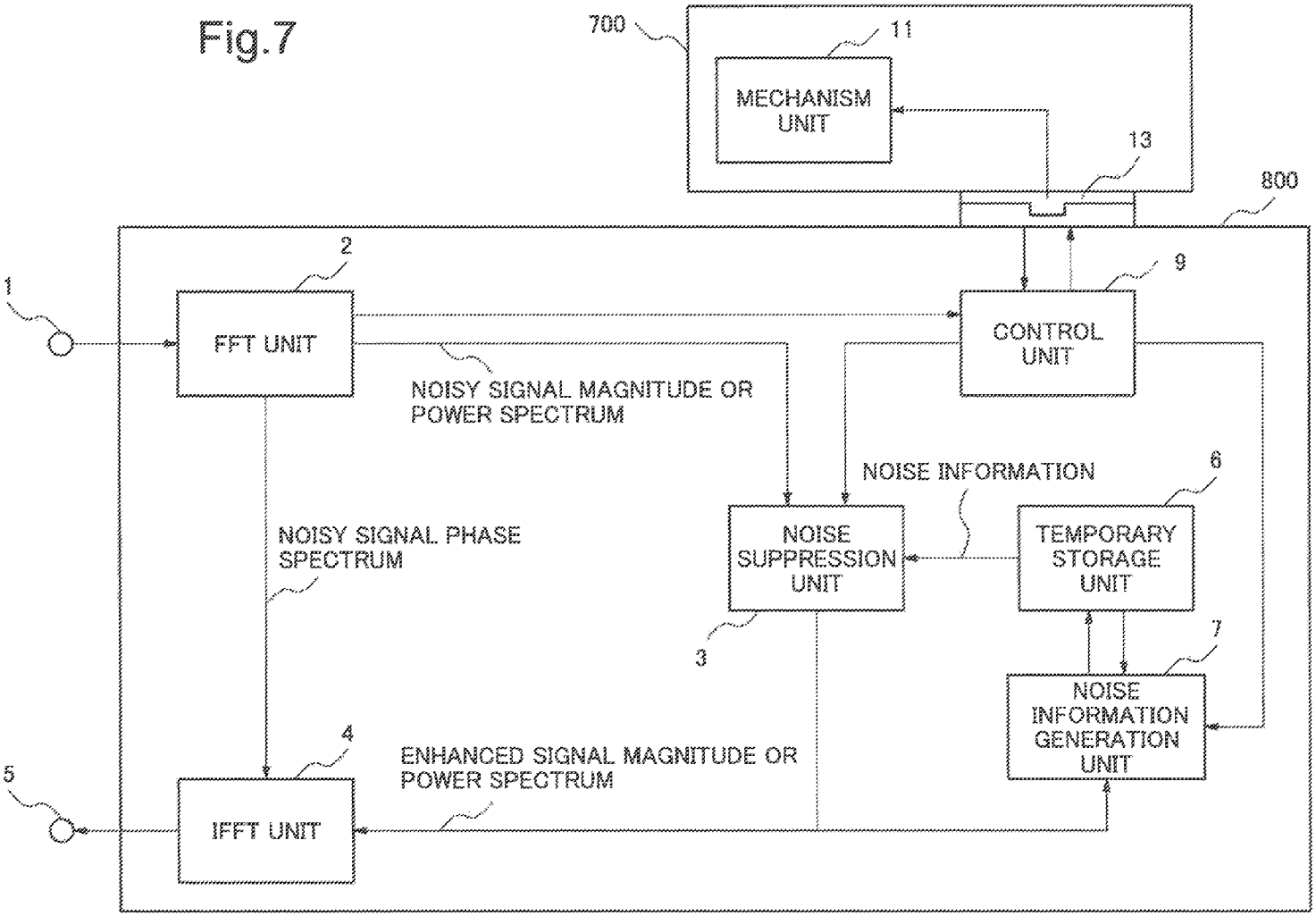
FIG. 7 is a block diagram showing the schematic arrangement of the information processing system according to the fifth exemplary embodiment of the present invention.

A fifth exemplary embodiment of the present invention will be described by using FIG. 7. An information processing apparatus 800 in this exemplary embodiment includes the control unit 9. By contrast, an auxiliary device 700 does not include the mechanism control unit and the mechanism unit 11 is controlled from the control unit 9. The control unit 9 inputs the spectrum signal outputted by the FFT unit 2, analyzes it, and determines whether or not an input of a signal [aks1] other than the noise is smaller than the predetermined threshold value.

In even this case, the same effect as the third exemplary embodiment can be obtained.

Sixth Exemplary Embodiment

Figure 8:
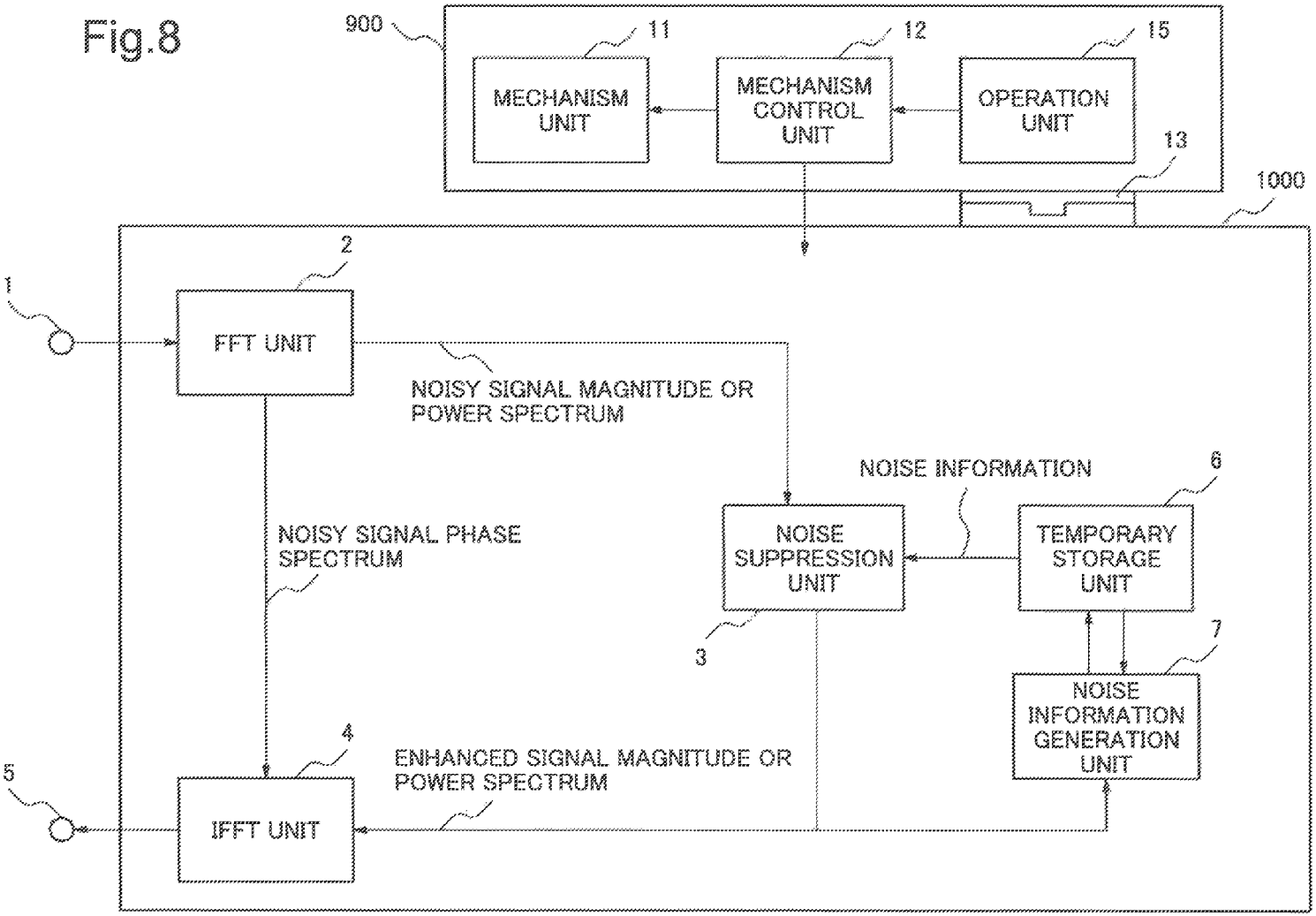
FIG. 8 is a block diagram showing the schematic arrangement of the information processing system according to the sixth exemplary embodiment of the present invention.

A sixth exemplary embodiment of the present invention will be described by using FIG. 8. An auxiliary device 900 of this exemplary embodiment includes an operation unit 15. The operation unit 15 receives a noise generation operation from a user and notifies the mechanism control unit 12 of the operation input. The mechanism control unit 12 makes the mechanism unit 11 operates in response to the operation input and whereby, the noise is generated. At the same time, the mechanism control unit 12 notifies an information processing apparatus 1000 of information indicating that the operation input is performed.

When the information processing apparatus 1000 receives the notification indicating that the operation input is performed from the mechanism control unit 12, it makes the noise suppression unit 3 and the noise information generation unit 7 operates at the predetermined timing. The information processing apparatus 1000 inputs the noise generated by the mechanism unit 11 from the input terminal 1, the noise is suppressed by the noise suppression unit 3, the noise suppression result is supplied to the noise information generation unit 7, the noise information according to the noise suppression result is generated, and it is overwritten and stored in the temporary storage unit 6.

With respect to the predetermined timing, a predetermined condition such as for example, "for 2 seconds after operation input is performed" or the like is stored in each of the auxiliary device 900 and the information processing apparatus 1000. In the auxiliary device 900, the mechanism unit 11 is controlled and the information processing apparatus 1000 makes the noise information generation unit 7 operate and whereby, the noise information is generated from the generated noise.

As a result, the information processing apparatus 1000 can certainly suppress the noise at the timing at which the specific noise exists and at the same time, generate the noise information. The arrangement other than the arrangement explained in this exemplary embodiment and the operation are the same as those of the first exemplary embodiment. Therefore, the detailed description will be omitted here.

Seventh Exemplary Embodiment

Figure 9:
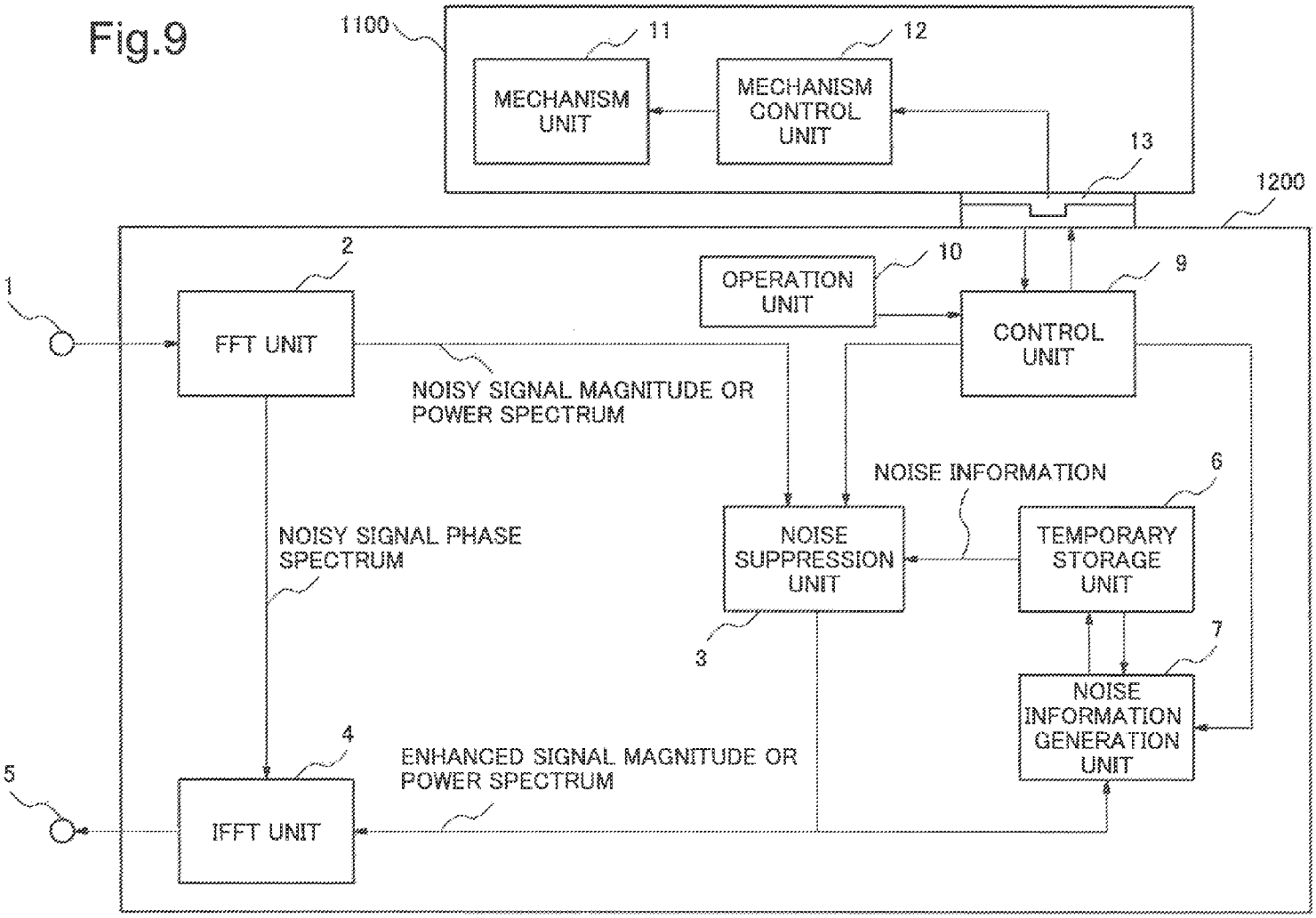
FIG. 9 is a block diagram showing the schematic arrangement of the information processing system according to the seventh exemplary embodiment of the present invention.

A seventh exemplary embodiment of the present invention will be described by using FIG. 9. An information processing apparatus 1200 according to this exemplary embodiment includes an operation unit 10. The operation unit 10 receives a noise generation operation from a user and notifies the mechanism control unit 12 of an auxiliary device 1100 of the operation input via the control unit 9. The mechanism control unit 12 makes the mechanism unit 11 operates in response to the operation input and whereby, the noise is generated. At the same time, the control unit 9 controls the noise suppression unit 3 and the noise information generation unit 7 at the predetermined timing and the noise information is generated from the generated noise.

As a result, the information processing apparatus 1200 can certainly suppress the noise at the timing at which the specific noise exists and at the same time, generate the noise information. The arrangement other than the arrangement explained in this exemplary embodiment and the operation are the same as those of the first exemplary embodiment. Therefore, the detailed description will be omitted here.

Eighth Exemplary Embodiment

Figure 10:
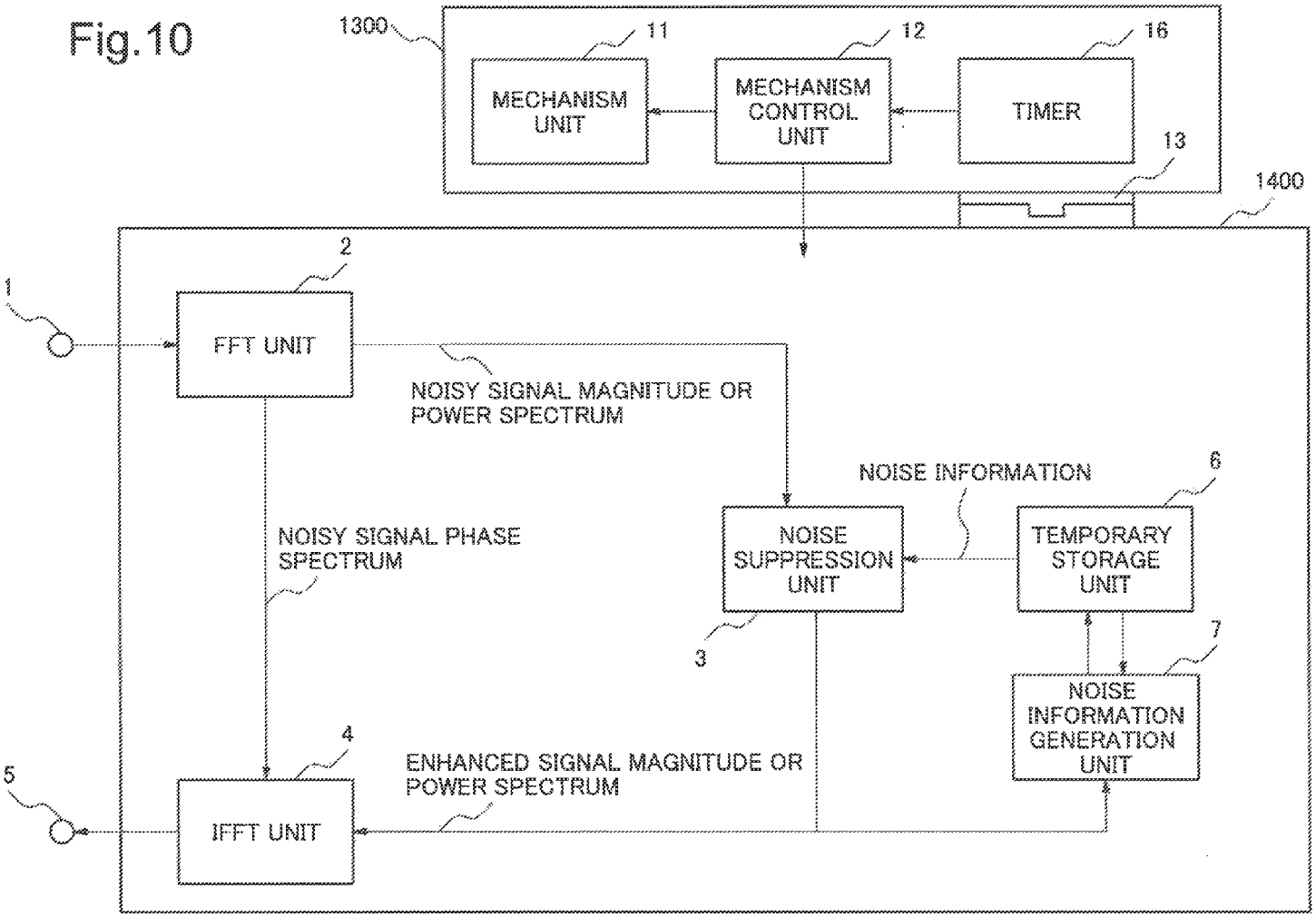
FIG. 10 is a block diagram showing the schematic arrangement of the information processing system according to the eighth exemplary embodiment of the present invention.

An eighth exemplary embodiment of the present invention will be described by using FIG. 10. An auxiliary device 1300 according to this exemplary embodiment includes a timer 16. The timer 16 notifies the mechanism control unit 12 of an elapse of a predetermined time. The mechanism control unit 12 makes the mechanism unit 11 operate in response to the notification and whereby, the noise is generated. At the same time, the mechanism control unit 12 notifies an information processing apparatus 1400 of the elapse of the predetermined time.

When the information processing apparatus 1400 receives the notification indicating the elapse of the predetermined time from the mechanism control unit 12, it makes the noise suppression unit 3 and the noise information generation unit 7 operate at the predetermined timing. The information processing apparatus 1400 inputs the noise generated by the mechanism unit 11 from the input terminal 1, the noise is suppressed by the noise suppression unit 3, the noise suppression result is supplied to the noise information generation unit 7, the noise information according to the noise suppression result is generated, and it is overwritten and stored in the temporary storage unit 6.

With respect to the predetermined timing, a predetermined condition such as for example, "for 2 seconds after elapse of predetermined time" or the like is stored in each of the auxiliary device 1300 and the information processing apparatus 1400. In the auxiliary device 1300, the mechanism unit 11 is controlled and the information processing apparatus 1400 makes the noise information generation unit 7 operates and generates the noise information from the generated noise.

A time measured by the timer 16 is for example, an elapsed time after the power is turned on, an elapsed time after the last noise generation operation, an elapsed time after reception of the noise generation operation, or the like. Further, the timer 16 may be configured as a part of the mechanism control unit 12.

By using this exemplary embodiment, the information processing apparatus 1400 can certainly suppress the noise at a timing at which the specific noise exists and at the same time, generate the noise information. The arrangement other than the arrangement explained in this exemplary embodiment and the operation are the same as those of the first exemplary embodiment. Therefore, the detailed description will be omitted here.

Another Exemplary Embodiment

The information processing apparatuses and the auxiliary devices that have been explained in the first to eighth exemplary embodiments described above have different features, respectively. Any combination of the information processing apparatus and the auxiliary device is also included in a category of the present invention. For example, an arrangement in which the auxiliary device 900 includes the connection sensor 14, the operation unit 15, and the timer 16, the mechanism control unit 12 controls the mechanism unit 11 in response to the notification transmitted by any one of these units, and whereby, noise is generated may be used.

The present invention is also applicable when the signal processing program of software for implementing the functions of the exemplary embodiments to the system or apparatus directly or from a remote site. Hence, the present invention also incorporates a program that is installed in a computer to cause the computer to implement the functions of the present invention, a medium that stores the program, and a WWW server from which the program is downloaded.

Figure 11:
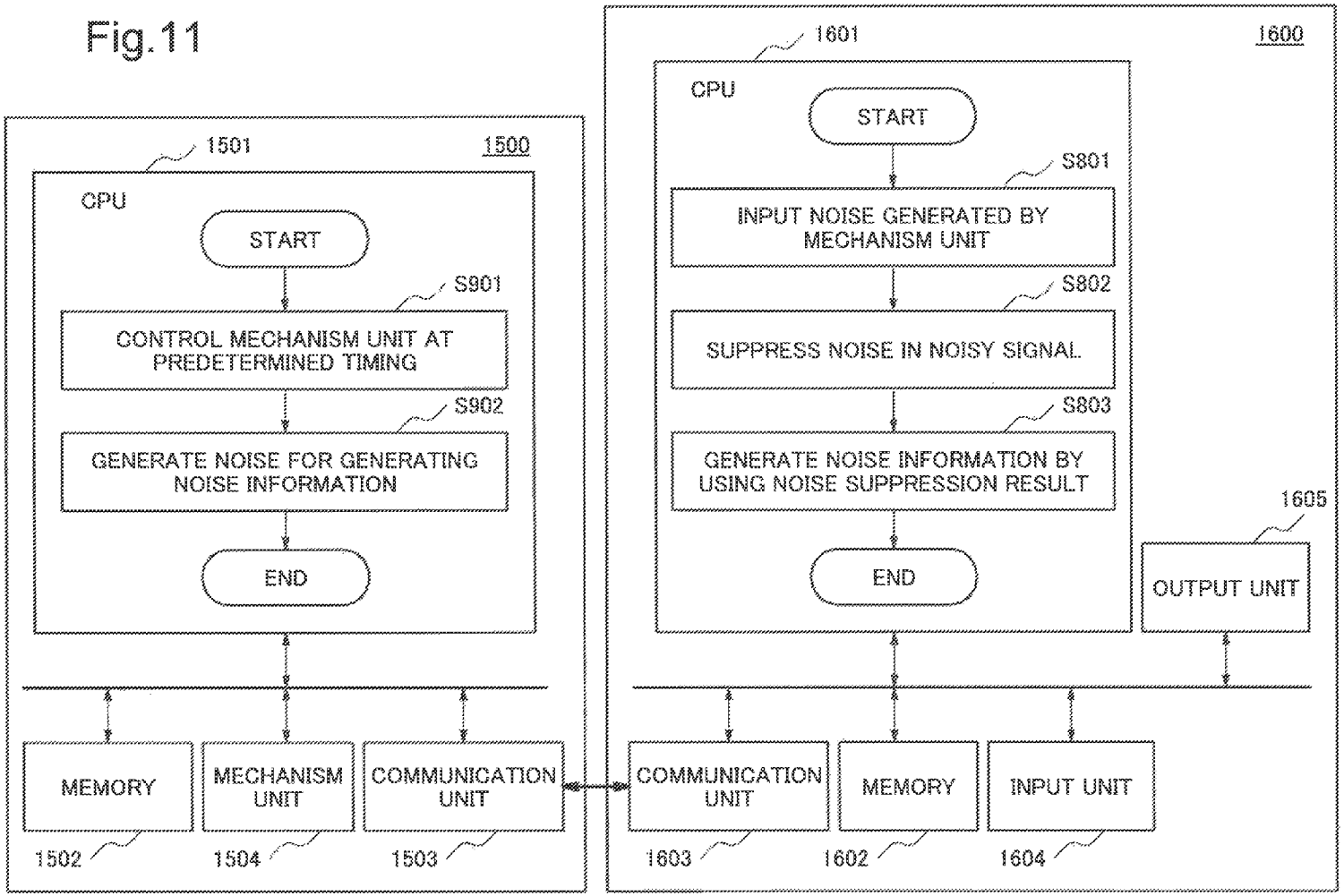
FIG. 11 is a block diagram showing the schematic arrangement of the computer system which executes the signal processing program according to another exemplary embodiment of the present invention.

The exemplary embodiment of the present invention can be realized by using a signal processing program. The arrangement of this case is shown in FIG. 11. Broad computers 1500 and 1600 execute a signal processing program. The computer 1500 includes a CPU 1501, a memory 1502, a communication unit 1503, and a mechanism unit 1504 and functions as the auxiliary device in the above-mentioned exemplary embodiment. On the other hand, the computer 1600 includes a CPU 1601, a memory 1602, a communication unit 1603, an input unit 1604, and an output unit 1605 and functions as the information processing apparatus in the above-mentioned exemplary embodiment.

The CPU 1501 reads the information processing program and controls the operation of the computer 1500. Namely, the CPU 1501 which executes the information processing program for the auxiliary device makes the mechanism unit 1504 operates at a predetermined timing (S901) and whereby, the noise is generated for generation of the noise information (S902).

On the other hand, the CPU 1601 which executes the information processing program for the information processing apparatus inputs the noise generated by the mechanism unit via the input unit 1604 (S801). The CPU 1601 suppresses the noise in the noisy signal (S802) and generates the noise information based on the noise suppression result (S803).

An advantageous effect that is the same as that of the first exemplary embodiment can be obtained by the computer system configured as described above.

While the present invention has been described above with reference to exemplary embodiments, the invention is not limited to the exemplary embodiments. The arrangement and details of the present invention can variously be modified without departing from the spirit and scope thereof, as will be understood by those skilled in the art.

The invention claimed is:

1. An auxiliary device which can be connected to an information processing apparatus, wherein the information processing apparatus comprises a noise suppression unit which suppresses noise in a noisy signal by using noise information stored in advance and a noise information generation unit which updates the noise information based on a result in which the noise in the noisy signal is suppressed and the auxiliary device comprises a mechanism unit which generates noise to be suppressed by the noise suppression unit and a mechanism control unit which controls the mechanism unit so that the noise occurs at a timing at which the noise suppression unit performs a noise suppression process.

2. The auxiliary device described in claim 1 further comprising a sensor for detecting a connection with the information processing apparatus, wherein the mechanism control unit receives a detection signal from the sensor and controls the mechanism unit so that the noise occurs.

3. The auxiliary device described in claim 1, wherein the mechanism control unit receives an instruction from a control unit provided in the information processing apparatus and controls the mechanism unit so that the noise occurs.

4. The auxiliary device described in claim 1 further comprising an operation unit which receives a noise generation operation from a user, when the operation unit receives the noise generation operation, the mechanism control unit controls the mechanism unit so that the noise occurs.

5. The auxiliary device described in claim 1 further comprising a timer for measuring an elapsed time, wherein the mechanism control unit controls the mechanism unit so that the noise occurs when the timer detects an elapse of a predetermined time.

6. An information processing apparatus to which an auxiliary device can be connected, wherein the auxiliary device comprises a mechanism unit which generates noise, and a mechanism control unit which controls the mechanism unit and makes the mechanism unit generate the noise, wherein the information processing apparatus comprises:

a noise suppression unit which suppresses noise generated by the mechanism unit by using noise information stored in advance;

a noise information generation unit which updates the noise information based on a result in which the noise generated by the mechanism unit is suppressed; and a control unit which controls the mechanism unit and makes the mechanism unit generate the noise at a timing at which the noise suppression unit suppresses the noise.

7. The information processing apparatus according to claim 6 wherein the control unit determines a mixed level of a signal other than the noise included in the inputted noisy signal, and controls the mechanism unit and makes the mechanism unit generate the noise when the mixed level is smaller than or equal to a predetermined value.

8. The information processing apparatus according to claim 6, further comprising:

an operation unit which receives a noise generation operation from a user, wherein the control unit controls the mechanism unit so that the noise occurs when the noise generation operation to the operation unit is received.

9. The information processing apparatus according to claim 6, wherein the noise suppression unit suppresses the noise and the noise information generation unit generates the noise information, according to an instruction from the mechanism control unit, respectively.

10. An information processing system including an information processing apparatus and an auxiliary device connected to the information processing apparatus wherein the information processing apparatus comprises a noise suppression unit which suppresses noise in a noisy signal by using noise information stored in advance and a noise information generation unit which updates the noise information based on a result in which the noise in the noisy signal is suppressed and the auxiliary device comprises a mechanism unit which generates noise to be suppressed by the noise suppression unit and a mechanism control unit which controls the mechanism unit so that the noise occurs at a timing at which the noise suppression unit performs a noise suppression process.

11. A method for controlling an auxiliary device which can be connected to an information processing apparatus wherein the information processing apparatus suppresses noise in a noisy signal by using noise information stored in advance and updates the noise information based on a result in which the noise in the noisy signal is suppressed and the auxiliary device generates noise to be suppressed by the noise suppression unit at a timing at which the information processing apparatus performs a noise suppression process.

12. A method for controlling an information processing apparatus to which an auxiliary device including a mechanism unit which generates noise and a control unit which controls the mechanism unit so that the noise occurs at a timing at which the noise suppression unit performs a noise suppression process comprising the steps of:

suppressing the noise in a noisy signal generated by the mechanism unit by using noise information stored in advance and updating the noise information based on a result in which the noise in the noisy signal is suppressed.

13. A method for controlling an information processing system including an information processing apparatus and an auxiliary device connected to the information processing apparatus comprising the steps of:

controlling the auxiliary device to generate noise to be suppressed in the information processing apparatus at a timing at which the information processing apparatus performs a noise suppression process, inputting a noisy signal in which the noise generated in the auxiliary device exists, suppressing the noise in the noisy signal by using noise information stored in advance, and updating the noise information based on a result in which the noise in the noisy signal is suppressed.

14. A computer readable non-transitory medium for storing a control program for an auxiliary device which can be connected to an information processing apparatus, wherein the information processing apparatus comprises a noise suppression unit which suppresses noise in a noisy signal by using noise information stored in advance and noise information generation unit which updates the noise information based on a result in which the noise in the noisy signal is suppressed, the auxiliary device comprises a mechanism unit which generates noise to be suppressed by the noise suppression unit, and the control program for the auxiliary device causes a computer to perform a process for controlling the mechanism unit so that the noise is generated at a timing at which the noise suppression unit performs a noise suppression process.

15. A computer readable non-transitory medium for storing a control program for an information processing apparatus to which an auxiliary device including a mechanism unit so that the noise occurs at a timing at which the noise suppression unit performs a noise suppression process, wherein the control program causes a computer to perform:

a process for suppressing the noise in a noisy signal generated by the mechanism unit by using noise information stored in advance and a process for updating the noise information based on a result in which the noise in the noisy signal is suppressed.

16. An auxiliary device which can be connected to an information processing apparatus, wherein the information processing apparatus comprises noise suppression means for suppressing noise in a noisy signal by using noise information stored in advance and noise information generation means for updating the noise information based on a result in which the noise in the noisy signal is suppressed and the auxiliary device comprises a mechanism unit which generates noise to be suppressed by the noise suppression means and a mechanism control unit which controls the mechanism unit so that the noise occurs at a timing at which the noise suppression means perform a noise suppression process.

17. An information processing apparatus to which an auxiliary device can be connected, wherein the auxiliary device comprises a mechanism unit which generates noise and a mechanism control unit which controls the mechanism unit to generate the noise, and, the information processing apparatus comprises noise suppression means for suppressing noise generated by the mechanism unit by using noise information stored in advance and noise information generation means for updating the noise information based on a result in which the noise generated by the mechanism unit is suppressed, and a control means for controlling the mechanism unit and making the mechanism unit generate the noise at a timing at which the noise suppression unit suppresses the noise.

18. An information processing system including an information processing apparatus and an auxiliary device connected to the information processing apparatus wherein the information processing apparatus comprises noise suppression means for suppressing noise in a noisy signal by using noise information stored in advance and noise information generation means for updating the noise information based on a result in which the noise in the noisy signal is suppressed and the auxiliary device comprises a mechanism unit which generates noise to be suppressed by the noise suppression means and a mechanism control unit which controls the mechanism unit so that the noise occurs at a timing at which the noise suppression means performs a noise suppression process.

* * * * *